United States Patent [19]

Baumann et al.

[11] Patent Number: 4,465,417

[45] Date of Patent: Aug. 14, 1984

[54] SYSTEM FOR HANDLING VEHICLES OF A REVOLVING CABLEWAY IN A PARKING STATION

[75] Inventors: Erich Baumann; Klaus Eisenkolb; Werner Morawietz, all of Linz, Austria

[73] Assignee: Voest-Alpine Aktiengesellschaft, Linz, Austria

[21] Appl. No.: 310,814

[22] Filed: Oct. 13, 1981

[30] Foreign Application Priority Data

Nov. 7, 1980 [AT] Austria ..... 5471/80

[51] Int. Cl.[3] ..... B65G 17/34; E04H 6/34

[52] U.S. Cl. ..... 414/235; 198/347; 198/473; 198/681; 414/248

[58] Field of Search ..... 198/471, 472, 473, 523, 198/560, 568, 681, 683, 347; 104/48, 50; 414/233, 234, 235, 236, 237, 238, 239, 240, 241, 248

[56] References Cited

U.S. PATENT DOCUMENTS 3,002,635 10/1961 Holland ..... 198/347
3,126,114 3/1964 Nakahara ..... 198/681 X

FOREIGN PATENT DOCUMENTS 123914 7/1931 Austria .
1268649 5/1968 Fed. Rep. of Germany .

*Primary Examiner*—James L. Rowland
*Attorney, Agent, or Firm*—Kurt Kelman

[57] ABSTRACT

At least one hanger rail having opposite ends is provided to support a plurality of parked vehicles. Two conveyor lines are associated with the hanger rail and extend transversely thereto to deliver the vehicles to one hanger rail and to receive parked vehicles from the other hanger rail means. Each conveyor line is associated with a respective end of the hanger rail, and the two conveyor lines are driven in mutually opposite directions of conveyance. Each conveyor line comprises an endless series of vehicle carriers, each of which is adapted to carry one of said vehicles and is of like cross section as the hanger rails.

3 Claims, 3 Drawing Figures

SYSTEM FOR HANDLING VEHICLES OF A REVOLVING CABLEWAY IN A PARKING STATION

Figure 1:
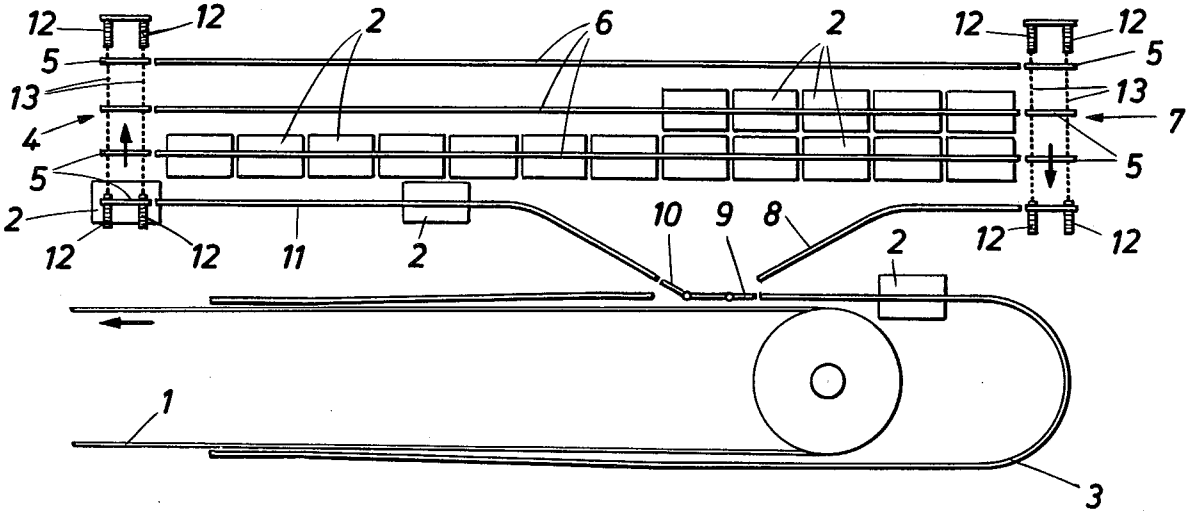

This invention relates to a system for parking the vehicles of a revolving cableway on parallel hanger rails, comprising conveying means which are associated with the hanger rails and extend transversely thereto and serve to move the vehicles to and from the hanger rails.

To minimize the space required to park vehicles of a revolving cableway, it is known to move the vehicles to a plurality of parallel hanger rails. The spacing of such hanger rails depends only on the width of the vehicles rather than on the smallest possible radius of a curved track, as would be the case if the hanger rails were incorporated in a continuous winding track. For handling the vehicles, conveying means are required, which extend transversely to the hanger rails and can move the vehicles individually from the hanger rails to parking station track rails leading to the cable and back to the hanger rails. In known systems, such conveying means comprise a car receiving one vehicle at a time and from which the vehicle can be pushed onto a hanger rail or a parking station track rail. That arrangement involves a substantial disadvantage because the delivery of the vehicles to the hanger rails and the removal of the vehicles from the hanger rails cannot be effected in a continuous manner. Besides, such systems require rather expensive control equipment if the vehicles are to be automatically delivered to and removed from the hanger rails.

It is an object of the invention to avoid these disadvantages and so to improve a system for parking the vehicles of a revolving cableway that a continuous delivery and removal of vehicles to and from the hanger rails will be permitted whereas only a small space is required.

This object is accomplished in accordance with the invention with conveying means comprising two oppositely moving conveyor lines associated with opposite ends of the hanger rails and each of which comprises a plurality of vehicle carriers arranged in succession in an endless series and adapted to carry respective vehicles.

Because the two conveyor lines respectively deliver the vehicle carriers to the hanger rails and receive them therefrom, the conveying means need not perform an idle movement when they have delivered a vehicle at one end of the conveyor line and move to pick up another vehicle at the other end of the line. Besides, the velocity of the conveying means can be decreased and the rate of conveyance can be greatly increased so that the vehicles which are successively uncoupled from the revolving cable can be forwarded by the conveying means to the hanger rails at the velocity at which the revolving cable revolves. Because the two conveyor lines associated with opposite ends of the hanger rails have mutually opposite directions of conveyance the delivery of the arriving vehicles to the hanger rails and the removal of vehicles from the hanger rails can be effected at the same time. This applies to systems in which the conveying means are centrally disposed between two sets of hanger rails, as well as to systems in which the conveyor lines are associated with opposite ends of the hanger rails of a group. If the conveying means are centrally disposed, only one set of hanger rails can be loaded and the other set can be loaded at the same time. When it is desired to unload the set of hanger rails which have previously been loaded, it will be necessary to reverse the conveying means.

If the conveyor lines are associated with respective ends of one hanger rail, the latter can be loaded and unloaded at the same time without a reversal of the conveying means.

Various designs may be adopted for the conveyor, inclusive of a revolving conveyor having two sections which constitute the conveyor lines, particularly if the conveyor is centrally arranged. Particularly desirable conditions will be obtained if, in accordance with a further feature of the invention, each conveyor line consists of two endless parallel conveyor chains, which are trained around reversing sprockets and interconnected by transverse axles which carry the vehicle carriers. A conveyor line consisting of a pair of revolving chains will constitute simple means for properly guiding the receptacles for the vehicles. The vehicle carriers consist of carrying rails which are similar in cross-section to the hanger rails so that there is no need for special means for the transfer of the vehicles from the vehicle carriers to the hanger rails and from the hanger rails or the guide rails for guiding the vehicles to the conveying means to the vehicle carriers.

To ensure that the vehicle carriers will be closely adjacent to and aligned with the hanger rails and the guide rails in spite of a sag of the conveyor chains, rollers may be mounted on the transverse axles and may roll on supporting rails which extend along the conveyor line to support the vehicle carriers. Such supporting rails would be disturbing if they extended between the conveyor chains of a conveyor line. This will be avoided if the rollers are mounted on free end porti ns with which the transverse axles protrude beyond the conveyor chains.

In the control of the conveying means it would be undesirable to adjust the stopping points of the vehicle carriers for each hanger rail. This can be avoided if the vehicle carriers have the same center spacing as the parallel hanger rails. If the stopping point of one vehicle carrier corresponds to the position of one hanger rail, all other vehicle carriers will then also be aligned with respective hanger rails.

Where horizontal hanger rails are used, the vehicles which have been delivered by the conveying means to the hanger rails must be displaced on the latter by drive means or by hand. This will not be necessary if the hanger rails are properly inclined, provided that the two conveyor lines are provided on different levels. It will be understood that the conveyor line for delivering vehicles to the hanger rails will then be associated with the higher end of the hanger rails and the conveyor line for removing vehicles from the hanger rails will be associated with the lower end thereof.

Figure 2:
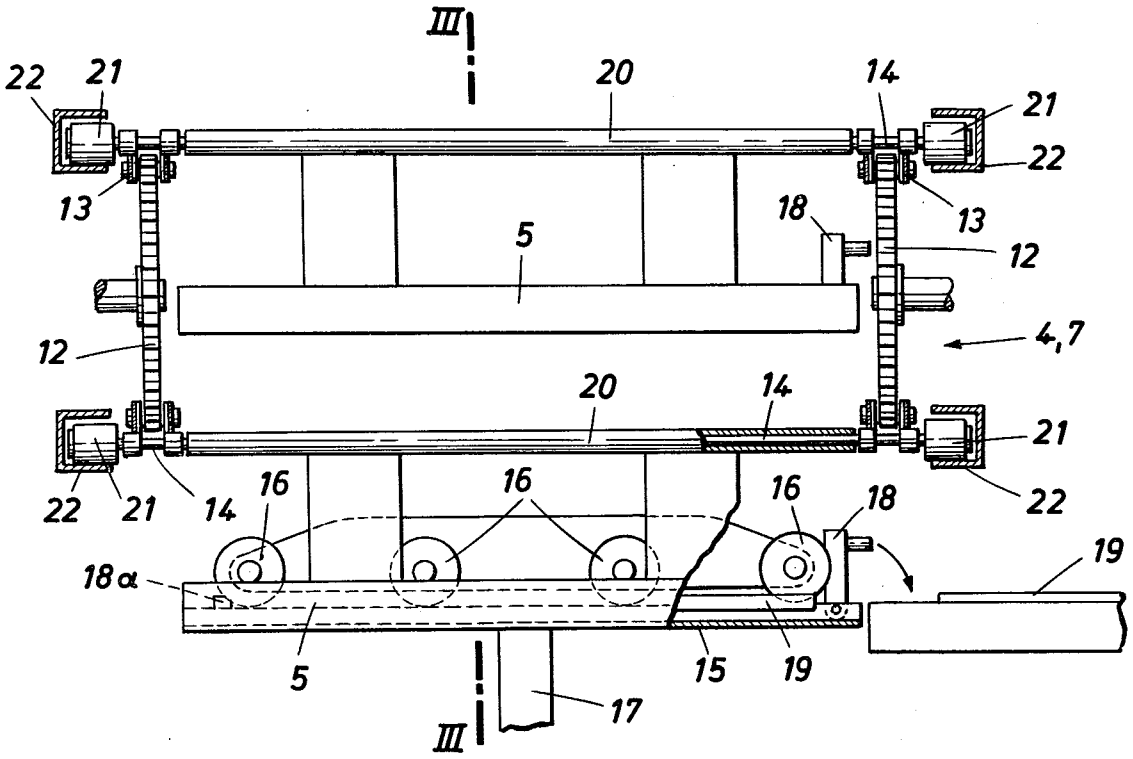
Figure 3:
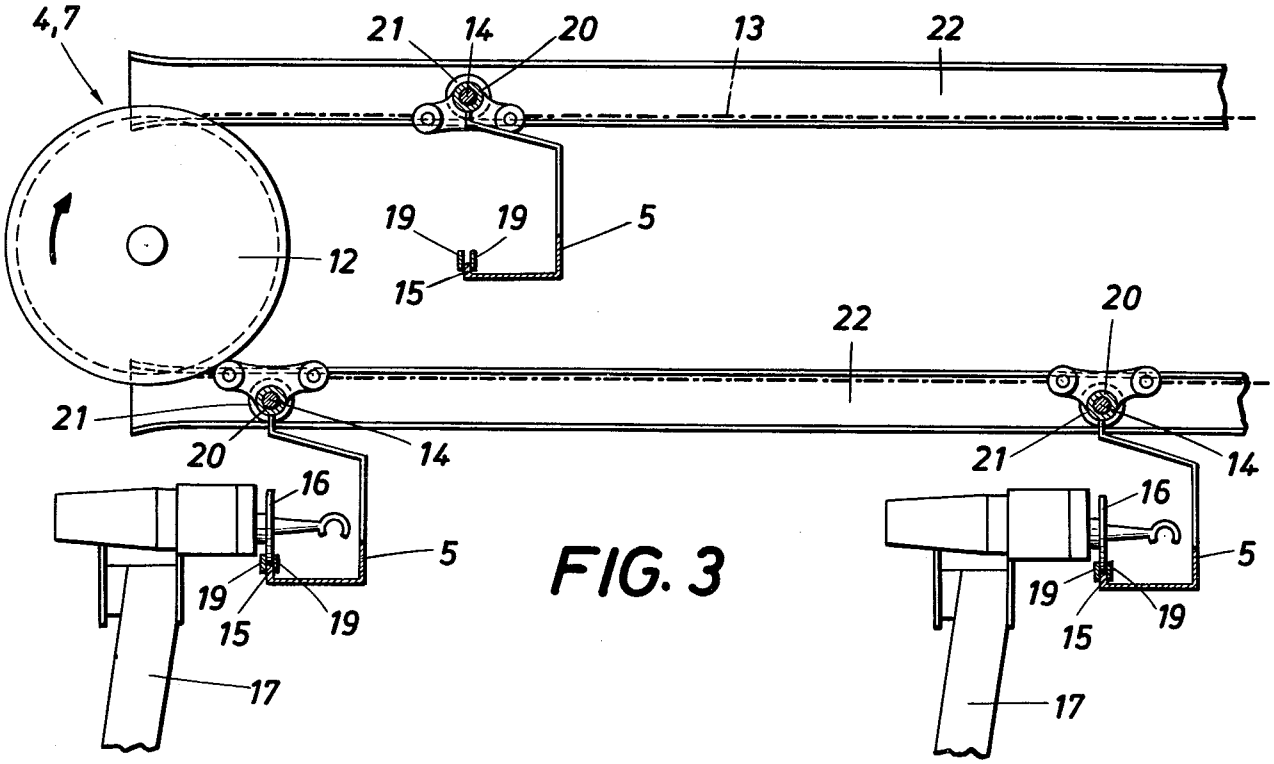

An embodiment of the invention is shown by way of example in simplified views in the drawings, in which FIG. 1 is a diagrammatic top plan view showing a system according to the invention for parking vehicles of a revolving cableway on parallel rails, FIG. 2 is a transverse sectional view showing a conveyor line associated with one end of the hanger rails and FIG. 3 is a sectional view taken on line III—III in FIG. 2.

A revolving cableway comprises a revolving cable 1 and vehicles 2, which may consist of cabins or chairs. The vehicles 2 are moved from a station track rail 3 to a delivering conveyor line 4, which comprises an endless series of successive vehicle carriers 5 consisting of carrying rails 15. The conveyor line 4 is adapted to receive the vehicles 2 and to deliver them to hanger rails 6, on which the vehicles are parked. A receiving conveyor line 7 which is similar to delivering conveyor line 4 is associated with the opposite end of the hanger rails 6 and serves to remove the vehicles 2 from the hanger rails 6 and comprises vehicle carriers 5 for receiving the vehicles 2 from the hanger rails 6. From the conveyor line 7, the vehicles 2 are moved on a guide rail 8 and a pivoted rail 9 to the station track rail 3 leading to the revolving cable 1. The station track rail 3 is similarly connected to the conveyor line 4 by a pivoted rail 10 and a guide rail 11.

As each of the delivering and receiving conveyor lines 4 and 7 comprises an endless series of vehicle carriers 5, each conveyor line 4 or 7 can handle a plurality of vehicles 2 at a time so that the hanger rails 6 can be continuously loaded and unloaded while the direction of conveyance of the conveyor lines remains unchanged. Where two separate conveyor lines are used for loading and unloading, vehicles can also be parked on the conveyor lines and the guide rails 11 and 8 which connect the conveyor lines to the station track rail 3; this will not affect the operative condition of the system. In that way, the number of hanger rails 6 may be required and even a single hanger rail 6 may be sufficient.

As is apparent from FIGS. 2 and 3, each of the two conveyor lines 4 and 7 comprises two parallel endless conveyor chains 13 trained around reversing sprockets 12 and interconnected by transverse axles 14. The transverse axles 14 have the same center spacing as the hanger rails and carry the carriers 5 for the vehicles 2. These vehicle carriers 5 consist of carrying rails 15, which are of a like cross-section as that of the hanger rails 6. For this reason the rollers 16 of the suspension gear 17 of the vehicles 2 can roll directly from the carrying rails 5 onto the hanger rails 6 when the carrying rails 15 are aligned with the hanger rails 6. This can be accomplished in a very simple manner because the center spacing of the transverse axles 14 has been properly selected. The transfer of the vehicles from the vehicle carriers 5 of the conveyor lines to the hanger rails 6 and between the vehicle carriers 5 and the guide rails 8 and 11 is facilitated by bridging members 18, each of which is pivoted to one of the carrying rails 15 at one end thereof and continues the lateral guides 19 of the carrying rail 15 and of the adjacent hanger rail 6 and bridges the gap between said rails. That bridging member 18 can be swung up to serve as an abutment which prevents an undesired movement of the vehicle from the carrying rail 15. At the end opposite to the bridging member 18, each carrying rail 15 has a stop 18*a*, which prevents the vehicle 2 from sliding to the other side.

The two courses of each conveyor chain 13 must be sufficiently spaced apart to ensure that the vehicle carriers 5 associated with the upper course of each conveyor chain can be returned freely to the receiving end of the conveyor line. Each vehicle carrier 5 can be pivoted on the transverse axle 14 by means of a sleeve 20.

In order to support the vehicle carriers 5 as they move along the conveyor lines and to ensure a smooth transfer of the vehicles between the vehicle carriers and the adjacent rails, the transverse axles 14 carry rotatably mounted rollers 21 running on channel-shaped supporting rails 22. Obviously the supporting rails 22 must not extend into the path for the vehicle carriers 5. This requirement can be met in a simple manner with the transverse axles 14 having end portions which protrude beyond the conveyor chains 13 and on which the rollers 21 are rotatably mounted.

Owing to the provision of the two conveyor lines 4 and 7 associated with opposite ends of the hanger rails, the handling of the vehicles 2 can be controlled in a simple manner, particularly if the hanger rails 6 are inclined so that there is no need to drive the vehicles on the hanger rails. Simple latches are sufficient, which prevent a delivery of a vehicle to a hanger rail before the preceding hanger rail has been fully loaded. A pushing drive, e.g., a fluid-operated cylinder, will be sufficient to push the vehicles from the carrying rails 15 of the vehicle carriers 5 to the hanger rails.

It will be understood that the invention is not restricted to the embodiment shown and described by way of example. For instance, the endless chains may be replaced by cable or belt conveyors and the vehicle carriers of each conveyor line need not be secured to two endless conveyor elements. A single conveyor chain or other endless conveyor element in each conveyor line may be sufficient. Besides, the vehicle carriers need not consist of rails but may have any other suitable design.

What is claimed is:

1. A system for handling a succession of vehicles of a revolving cableway in a parking station for the vehicles, which comprises (a) a plurality of equidistantly spaced, parallel hanger rails for supporting a plurality of the vehicles parked at said station, each one of the hanger rails having two ends, and (b) conveyor means associated with the hanger rails and operable to deliver respective ones of the vehicles from the cableway to a respective one of the hanger rails for parking and to receive respective ones of the parked vehicles from the hanger rails for return to the cableway, the conveyor means extending transversely to the hanger rails and comprising (1) a delivering conveyor line associated with one of the hanger rail ends, (2) a receiving conveyor line associated with the other hanger rail ends, and (3) drive means for operating the two conveyor lines in mutually opposite directions of conveyance, (4) each one of the conveyor lines comprising an endless series of vehicle carriers, each one of the vehicle carriers being adapted to carry one of said vehicles, the vehicle carriers being arranged parallel to the hanger rails at the same spacing as the hanger rails whereby a respective one of the vehicle carriers may be aligned with a respective one of the hanger rails for delivering a respective one of the vehicles to the respective hanger rail and for receiving a respective one of the vehicles from the respective hanger rail, and the vehicle carriers and hanger rails being of like cross section whereby the respective vehicles may be rectilinearly transferred between the conveyor lines and the rail hangers.

2. The system of claim 1, wherein the hanger rails and the vehicle carriers are vehicle carrying rails, the vehicles comprising rollers running on said rails.

3. The system of claim 1, wherein each one of the conveyor lines comprises two parallel endless conveyor chains, reversing pulleys, the conveyor chains being trained about the reversing pulleys, transverse axles connecting the two conveyor chains, the vehicle carriers being suspended on the transverse axles, supporting rails extending along and adjacent each one of the conveyor lines, the transverse axles having free ends protruding beyond the conveyor chains, and rollers rotatably mounted on the free ends and running on the supporting rails.

* * * * *